US007143957B2

(12) United States Patent
Nelson

(10) Patent No.: US 7,143,957 B2
(45) Date of Patent: Dec. 5, 2006

(54) TWO-AXIS FULL-CIRCLE SPRINKLER WITH BENT, ROTATING NOZZLE

(75) Inventor: Craig B. Nelson, Walla Walla, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 171 days.

(21) Appl. No.: 10/885,040

(22) Filed: Jul. 7, 2004

(65) Prior Publication Data

US 2006/0006253 A1 Jan. 12, 2006

(51) Int. Cl.
*B05B 3/02* (2006.01)

(52) U.S. Cl. ..... 239/222.21; 239/222.13; 239/222.15; 239/214.13; 239/224; 239/233; 239/214; 239/222.11

(58) Field of Classification Search ..... 239/214, 239/222.17, 214.13, 222.21, 224, 230, 233, 239/222.11, 237, 244, 225.1, 227, 231, 222.15
See application file for complete search history.

(56) References Cited

U.S. PATENT DOCUMENTS 1,488,356 A * 3/1924 Linke ..... 239/219
1,950,512 A * 3/1934 Norland ..... 239/222.13
2,989,248 A * 6/1961 Norland ..... 239/222.15
4,440,345 A 4/1984 Figwer et al.
4,796,811 A 1/1989 Davisson
RE33,823 E 2/1992 Nelson et al.
5,224,653 A 7/1993 Nelson et al.
5,297,737 A 3/1994 Davisson
5,372,307 A 12/1994 Sesser
5,439,174 A 8/1995 Sweet
5,588,595 A 12/1996 Sweet et al.

* cited by examiner

*Primary Examiner*—Dinh Q. Nguyen
(74) *Attorney, Agent, or Firm*—Nixon & Vanherhye P.C.

(57) ABSTRACT

A sprinkler device includes a sprinkler body having a longitudinal center axis, an inlet at one end and an outlet at an opposite end. A rotatable nozzle is supported within the body and defines a first flow path lying on the longitudinal center axis and a second flow path terminating at a discharge orifice offset from the longitudinal center axis. A rotor plate is supported on the nozzle for orbital motion about the longitudinal center axis and for rotation about a second axis offset from the longitudinal center axis. The rotor plate has a plurality of grooves formed therein, and arranged to cause the rotor plate to rotate about the second axis when a stream emitted from the nozzle impinges on the plate, such that the nozzle assembly is caused to rotate about the first axis.

18 Claims, 2 Drawing Sheets

TWO-AXIS FULL-CIRCLE SPRINKLER WITH BENT, ROTATING NOZZLE

TECHNICAL FIELD

This invention relates generally to sprinklers and, more particularly, to a two-axis, full-circle sprinkler with a rotatable offset nozzle and a rotor plate, each of which may incorporate a viscous brake device to slow the rotational speed of the respective components.

BACKGROUND OF THE INVENTION

It is well known in the field of irrigation generally and rotating sprinklers particularly for a sprinkler device to emit a non-rotating stream from a fixed nozzle onto a rotating plate with substantially radial grooves that also establish a moment arm, causing the plate (often referred to as a "rotor plate") to rotate about the nozzle axis. The plate also reorients the stream from vertical to substantially horizontal, distributing the water in a circular pattern. The grooves of the rotor plate may be configured to produce different wetting patterns, depending on specific site applications. In some cases, the rotation of the rotor plate is slowed by a viscous brake or "motor" in order to maximize the throw radius of the stream. In other cases, the rotor may be of the free-spinning type. Examples of such sprinkler constructions may be found in commonly owned U.S. Pat. Nos. Re. 33,823; 4,796,811; 5,297,737; 5,372,307; 5,439,174; and 5,588,595. An offset rotating nozzle sprinkler incorporating viscous damping is disclosed in U.S. Pat. No. 4,440,345.

It is nevertheless desirable to improve the performance characteristics of such sprinkler devices, and to build in greater flexibility with respect to producing desirable distribution curves in a simpler more cost effective manner.

BRIEF DESCRIPTION OF THE INVENTION

In accordance with the present invention, a two-axis, full-circle sprinkler is provided which includes a sprinkler body, a nozzle having an offset or bent discharge portion rotatably mounted in the body, and a rotor plate carried by the nozzle. Thus, the rotor plate orbits about a first axis and, at the same time, rotates about a second axis parallel to (or at an angle to) the first axis. In the disclosed embodiments, the first axis is the longitudinal center axis of the sprinkler. The offset orifice thus also orbits about the first or longitudinal axis with the rotor plate. More specifically, the nozzle itself is bent radially outwardly and thus the nozzle orifice is offset from both the first and second axes and is arranged to emit a stream which will impinge on a plurality of grooves formed in the rotor plate. In one embodiment, the nozzle is formed with a pair of elbow bends, so that the nozzle body and the discharge orifice are vertically oriented and connected by a short horizontal portion. In an alternative embodiment, the nozzle is simply bent at about a 45° angle, and the rotor plate is shaped accordingly, to achieve a greater radius of throw.

The rotor plate may incorporate a first retarder device to slow the rotation of the plate about the second axis. The rotating nozzle may incorporate a second retarder device within the sprinkler body to slow its rotational speed about the longitudinal axis of the sprinkler. Alternatively, one or the other of the retarders may be omitted. Thus, various embodiments of free-spinning and/or braked components may be employed to achieve the desired sprinkling pattern. Other features include:

1. the sprinkler is capable of three hundred sixty degree (360°) coverage;
2. the rotor plate can be grooved to provide multiple stream trajectories and diffusion patterns;
3. multiple flow rates and pressures can be used with the rotor plate;
4. flexibility of pattern choices are facilitated by modular construction of various sprinkler components;
5. the sprinkler device is operable in different orientations; and
6. manufacturing procedures to achieve wide degree of flexibility are simplified.

Accordingly, in one aspect, the invention provides a sprinkler device comprising a sprinkler body having a longitudinal center axis, an inlet at one end and an outlet at an opposite end; a rotatable nozzle mounted within the body and defining a first flow path lying on the longitudinal center axis and a second flow path terminating at a discharge orifice offset from the longitudinal center axis; a rotor plate supported on a shaft fixed to the nozzle for orbital motion about the longitudinal center axis and for rotation about a second axis offset from the longitudinal center axis, the rotor plate having grooves formed therein shaped to cause the rotor plate to rotate about the second axis when a stream emitted from the nozzle impinges on the plate, and wherein the nozzle is thereby caused to rotate about the first axis.

In another aspect, the invention provides a sprinkler device comprising a body portion having a fluid passage therethrough defining a first longitudinal axis; a nozzle component mounted for rotation in the body portion about the first longitudinal axis, the nozzle component having a discharge orifice radially offset from the first longitudinal axis; and a rotor plate supported downstream of the nozzle component for rotation about a second axis offset from the first longitudinal axis, and for orbital motion about the first longitudinal axis, the rotor plate having a plurality of grooves therein and located such that a stream emitted from the discharge orifice impinges on the grooves.

The invention will now be described in detail in conjunction with the drawings identified below.

DETAILED DESCRIPTION OF THE INVENTION

Figure 1:
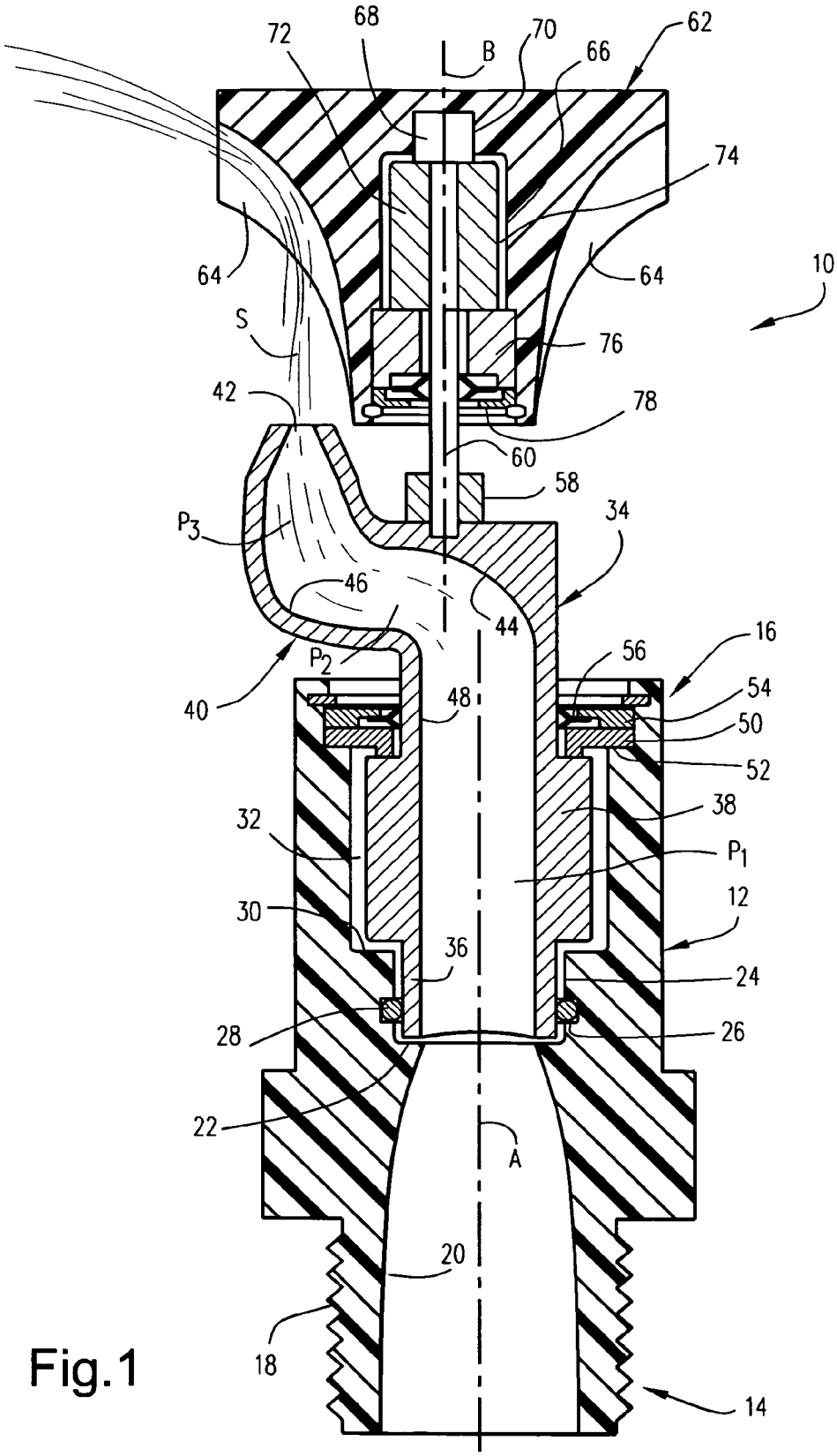
FIG. 1 is a front elevation, partly in section, of the two-axis, full-circle sprinkler in accordance with a first exemplary embodiment of the invention.

With reference to FIG. 1, the sprinkler 10 in accordance with a first exemplary embodiment of the invention includes a body 12 having an inlet end 14 and an outlet end 16. The inlet end 14 is exteriorly threaded at 18 for connection to a coupling, manifold, conduit or other device which receives water from a source. The body 12 has an interior flow passage 20 which, from the inlet end, tapers to an internal, annular shoulder 22. The body 12 has an intermediate, relatively small diameter section 24, with an annular groove 26 in a lower portion thereof. An O-ring seal 28 is seated in the groove.

The smaller diameter section 24 extends upwardly (as viewed in FIG. 1) to a larger annular shoulder 30, forming a lower end of a chamber 32.

A one-piece nozzle/rotor 34 is located within the body 12, with a lower, relatively small diameter end 36 lying adjacent the shoulder 22. A larger diameter, integral rotor portion 38 substantially fills the chamber 32, while a cranked nozzle 40 extends upwardly from the rotor 38. Thus, the tubular nozzle component has a first vertical path $P_1$, a substantially horizontal path $P_2$ and another substantially vertical path $P_3$ which terminates at the discharge orifice 42. These paths are defined by a straight or vertical section 48 of the nozzle (defining path $P_1$), and a pair of elbow bends 44, 46 between the straight section 48 and the discharge orifice 42 (defining paths $P_2$ and $P_3$). Note that the inside diameter of the hollow nozzle/rotor is substantially the same as the inner diameter at the radially inner edge of shoulder 22 so that there is a smooth flow transition from the sprinkler body 12 to the nozzle/rotor 34.

The remaining space in the chamber 32 is filled (or partially filled) with a viscous fluid, establishing a first speed retarding mechanism that will retard the rotational speed of the rotor/nozzle 34 about the axis A, and the viscosity of the fluid may be chosen to achieve the desired degree of braking. Preferably, a silicone fluid is employed. The O-ring seal 28 prevents any leakage of the viscous fluid from the lower end of the chamber 32. The upper end of the chamber 32 is closed by an annular upper bearing 50, seated on a shoulder 52 in the upper end region of the body 12. An annular seal member 54 is seated on the bearing 50, with a flexible seal element 56 in engagement with the section 48 of the nozzle which extends upwardly from the rotor 38 and out of the sprinkler body 12. Thus, chamber 32 is sealed by the O-ring seal 28 at one end of the chamber and the shoulder 52 at the opposite end of the chamber.

An integral boss 58 on the nozzle 40 supports a fixed, upstanding shaft 60, defining a second axis B, parallel to but offset from axis A. Alternatively, the second axis B could be at an angle relative to axis A. The latter mounts a rotatable water distribution plate 62, also referred to herein as a rotor plate. The rotor plate 62 is formed with a plurality of grooves 64 which extend substantially vertically and gradually transition to a substantially horizontal orientation. Examples of such rotor plates are found in U.S. Pat. Nos. 5,224,653 and 4,796,811. The grooves 64 are also formed to have a circumferential component (about the axis A) so that a stream S emitted from the orifice 42 of nozzle 40 striking the grooves 64 will cause the rotor plate 62 to rotate about the axis B as defined by the non-rotatable shaft 60. The rotation of the rotor plate 62 about axis B establishes a moment arm relative to axis A, thus causing the nozzle 40 to rotate in an opposite direction about axis A. Note that the nozzle 40 is not otherwise bent in a circumferential direction to cause the nozzle to rotate. The rotation of the nozzle here results solely from the moment caused by the water leaving the rotor plate 62. The nozzle 40 could be bent in a circumferential direction, however, to produce a conventional reactionary drive if so desired with rotation in the same direction as the rotor plate 62. Whether or not the nozzle is bent in a circumferential direction, it could be bent so as to emit a stream at an angle relative to axis A.

Because of the cranked nozzle 40, the stream S is emitted along a third axis parallel to but offset from the axis A (and also offset from axis B) and the shaft 60. Thus, the nozzle 40 and the rotor plate 62 will orbit about the axis A retarded by the first retarding mechanism, while the rotor plate itself rotates about the shaft 60 on axis B.

Within the rotor plate 62, there is a blind counterbore 66, with the other (enlarged) bearing end 68 of shaft 60 seated within a recess 70 formed in the plate. A stator 72 is fixed to the shaft 60 and is located within a chamber 74 defined by the closed end of the counterbore 66 and a cap/seal assembly 76, 78, similar to the seal assembly between the rotor 38 and the body 12. Chamber 74 is likewise filled (or partially filled) with a viscous fluid, thereby establishing a second speed retarding mechanism. Accordingly, rotation of the rotor plate 62 about shaft 60 is significantly retarded in substantially the same manner as the nozzle 40 to increase the radial throw distance of the stream S. It will be appreciated, however, that one or the other, or both, of the viscous retarders may be omitted, and/or the viscosity of the viscous fluid may be altered, depending on the desired sprinkling pattern.

Figure 2:
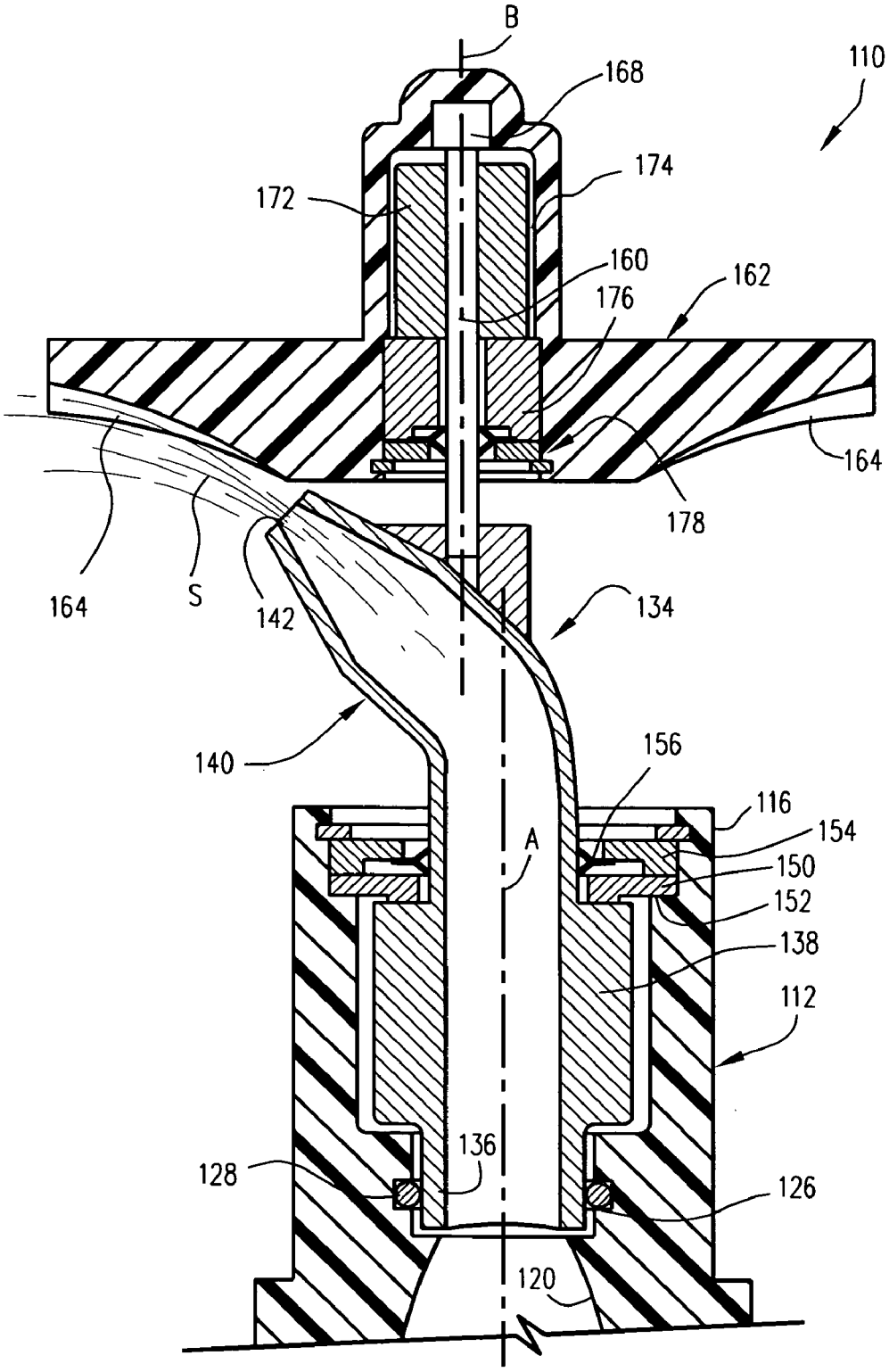
FIG. 2 is a front elevation, partly in section, of a two-axis, full-circle sprinkler in accordance with a second exemplary embodiment of the invention.

Turning to FIG. 2, a second exemplary embodiment of the invention is illustrated. For the sake of clarity and convenience, similar reference numerals are used to designate corresponding components, but with the prefix "1" added. For similar components, no detailed description is required. Rather, the discussion below focuses on the differences between the embodiments of FIGS. 1 and 2. In FIG. 2, the nozzle 140 is simply bent at an angle to the axis A so that the flow path includes only vertical and angled portions. Now, the orifice 142 emits a stream substantially tangential to a substantially horizontal groove 164 in the rotor plate 162. The rotor plate is redesigned relative to the rotor plate 62 in FIG. 1 in the sense that the grooves 164 are substantially more shallow with a significantly greater horizontal component vis-a-vis the grooves 64. This arrangement is thus suitable for applications where the greater radius of throw is called for. The operation of the device as well as the functions of the specific components thereof are otherwise similar to those in the embodiment illustrated in FIG. 1.

As already mentioned in connection with FIG. 1, rotor plate shafts 60 (FIG. 1) and 160 (FIG. 2) could also be tipped, i.e., angled relative to the longitudinal axis A of the sprinkler body to provide a different sprinkling pattern, i.e., the trajectory of the stream constantly changes due to the action of the grooved rotor plate rotating about a tilted axis.

In addition, while the illustrated embodiments employ viscous retarders to slow the rotation of the respective nozzles and rotor plates, other retarding means could be employed such as mechanical friction or gear mechanisms.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler device comprising a sprinkler body having a longitudinal center axis defining a first axis, an inlet at one end and an outlet at an opposite end; a rotatable nozzle mounted within said body and defining a first flow path lying on said longitudinal center axis and a second flow path terminating at a discharge orifice offset from said longitudinal center axis; a rotor plate supported on a shaft fixed to said nozzle for orbital motion about said longitudinal center axis and for rotation about a second axis offset from said longitudinal center axis, said rotor plate having grooves formed therein shaped to cause said rotor plate to rotate about said second axis when a stream emitted from said nozzle impinges on said plate, and wherein said nozzle is thereby caused to rotate about said first axis, wherein said second axis is substantially parallel to said first axis.

2. The device of claim 1 and including means for slowing the rotation of said rotor plate about said second axis.

3. The device of claim 1 and including means for slowing the rotation of the nozzle and orbital motion of said rotor plate about said longitudinal center axis.

4. The device of claim 2 and including additional means for slowing the orbital motion of said rotor plate about said longitudinal center axis.

5. The device of claim 1 wherein said rotor plate has a plurality of grooves extending substantially vertically at an inlet side thereof; said nozzle orifice arranged to emit a stream along a third axis substantially parallel to said first axis.

6. The device of claim 1 wherein said rotor plate has a plurality of grooves extending substantially horizontally, said nozzle bent so that said nozzle orifice emits a stream substantially tangentially to said grooves.

7. The device of claim 1 wherein said rotor plate is provided with an internal chamber having a quantity of viscous fluid therein, and wherein said shaft passes through said chamber and supports a fixed state element within said chamber, thereby slowing rotation of said rotor plate about said second axis.

8. The device of claim 7 wherein said rotor plate is mounted on said shaft for rotation.

9. The device of claim 1 wherein said sprinkler body is formed with a chamber, said rotatable nozzle having an integral rotor located within said chamber, said chamber at least partially filled with a viscous fluid.

10. The device of claim 1 wherein said first and second flow paths are substantially parallel, and are connected by a substantially horizontal flow path.

11. The device of claim 1 wherein said second flow path extends at an angle to said longitudinal axis.

12. A sprinkler device comprising:

a body portion having a fluid passage therethrough defining a first longitudinal axis;

a nozzle component mounted for rotation in said body portion about said first longitudinal axis, said nozzle component having a discharge orifice radially offset from said first longitudinal axis; and a rotor plate supported downstream of said nozzle component for rotation about a second axis offset from said first longitudinal axis, and for orbital motion about said first longitudinal axis, said rotor plate having a plurality of grooves therein and located such that a stream emitted from said discharge orifice impinges on said grooves, wherein said second axis is substantially parallel to said first longitudinal axis.

13. The sprinkler device of claim 12 wherein said nozzle component includes two parallel flow paths connected by a third flow path substantially perpendicular to said two parallel flow paths.

14. The sprinkler device of claim 12 wherein said nozzle has a straight portion defining a first flow path and a bent portion defining a second flow path oriented at an angle relative to said first flow path.

15. The sprinkler device of claim 14 wherein said bent portion extends at about 45° to said straight portion.

16. The sprinkler device of claim 12 and including means for slowing the rotation of said rotor plate about said second axis.

17. The sprinkler device of claim 12 and including means for slowing the rotation of the nozzle and the orbital motion of said rotor plate about said longitudinal center axis.

18. The sprinkler device of claim 16 and including means for slowing the rotation of the nozzle and the orbital motion of said rotor plate about said longitudinal center axis.

* * * * *